United States Patent [19]

Fushiya et al.

[11] Patent Number: 4,625,462

[45] Date of Patent: Dec. 2, 1986

[54] CORDLESS ELECTRIC FINISHING SANDER

[75] Inventors: Fusao Fushiya; Nobuo Hakamata; Michio Okumura, all of Anjo, Japan

[73] Assignee: Makita Electric Works, Ltd., Anjo, Japan

[21] Appl. No.: 770,515

[22] Filed: Aug. 29, 1985

[30] Foreign Application Priority Data

Aug. 29, 1984 [JP] Japan ..... 59-181149

[51] Int. Cl.[4] ..... B24B 23/04

[52] U.S. Cl. ..... 51/170 MT; 51/386

[58] Field of Search ..... 51/170 R, 170 MT, 170 TL, 51/170 T, 382, 386, 387

[56] References Cited

U.S. PATENT DOCUMENTS

| | | | |
|---|---|---|---|
| 2,914,889 | 12/1959 | Mosbacher | 51/384 |
| 3,793,776 | 2/1974 | Sadow, Jr. et al. | 51/170 MT |
| 3,975,865 | 8/1976 | Lewis | 51/170 T |
| 4,027,348 | 6/1977 | Flower et al. | 51/170 MT |
| 4,075,793 | 2/1978 | Vogel et al. | 51/170 TL |
| 4,476,602 | 10/1984 | Hurn et al. | 51/170 T |

FOREIGN PATENT DOCUMENTS

| | | | |
|---|---|---|---|
| 2511392 | 9/1976 | Fed. Rep. of Germany | 51/386 |

*Primary Examiner*—Roscoe V. Parker

*Attorney, Agent, or Firm*—Dennison, Meserole, Pollack & Scheiner

[57] ABSTRACT

A portable cordless finishing sander is provided which has a housing, a sanding plate below the housing and a clamping arrangement for clamping a sheet of sandpaper to the sanding plate. The housing has a motor housing portion for storing an electric motor, an elongated handle portion extending above the motor housing portion for storing a battery, and a skirt portion extending below the motor housing portion. The housing is designed in relation to the handle portion and the skirt portion such that the weight of the handle portion encasing the battery is substantially equal to the weight of the skirt portion carrying the sanding plate in both vertical and longitudinal directions. The clamping arrangement includes a clamping member and an operating lever, which are normally stored within the skirt portion of the housing. A novel arrangement is provided for retaining the clamping member in its released position when the sandpaper is exchanged.

4 Claims, 11 Drawing Figures

CORDLESS ELECTRIC FINISHING SANDER

BACKGROUND OF THE INVENTION

1. Field of the Invention

This invention relates to a finishing sander having a flat rectangular sanding plate to which a sheet of sandpaper is clamped for effecting a smooth finish on a plane workpiece surface. More particularly, this invention relates to a cordless or battery-operated finishing sander having a clamping arrangement by means of which the sandpaper can be easily replaced.

2. Description of the Prior Art

The prior art finishing sanders include a power cord for the drive motor as disclosed in U.S. Pat. Nos. 3,345,784, 3,418,761 and 4,242,839 for example. It has been found that by the power cord arrangement, the finishing sanders have a limited range of movement, thereby reducing their maneuverability. Moreover, in these finishing sanders, a balance of weight is not obtained among the handle portion including the electric switch and the power cord, the motor housing and the skirt portion, particularly with respect to the longitudinal direction about the axis of the motor drive shaft. In order to cope with such problems, a second or forward control handle or the like is provided to maintain good weight balance of the sander.

In most of such constructions of sanders, a paper clamping arrangement is provided on the sanding plate. For example, U.S. Pat. Nos. 3,336,702 and 3,418,761 disclose a paper clamp member having knurled cylindrical sections by means of which the sandpaper is detachably gripped. With this construction, however, a screw driver or the like tool is required to turn the clamp member and thus considerable force is required to clamp the sandpaper to the sanding plate.

U.S. Pat. Nos. 3,345,784 and 2,914,889 disclose a clamp mechanism wherein the sandpaper is resiliently gripped on the sanding plate by a torsion spring. In clamping a sheet of sandpaper, the operator moves a clamp member depressed by the spring away from the sanding plate and, while holding this position by his one hand, he inserts the sandpaper with his other hand. It is recognized that exchange of sandpaper is inconvenient and considerable effort is required.

Various clamping mechanisms have been devised heretofore to facilitate the replacement of sandpaper. For example, U.S. Pat. No. 4,075,793 discloses a power sander including a clamping mechanism wherein the clamping member can be retained in the open position for more efficient replacement of the sandpaper. In this sander, however, a part of the clamping mechanism projects from the upper side of the skirt. During the operation, therefore, the sander may often engage a solid object or the operator's hand thereby actuating the clamping mechanism to unclamp the sandpaper. The projection may come into contact with the operator's body thereby resulting in injury. Further, the clamping mechanisms are provided on the opposite sides of the skirt. Apparently, this adds to the size of the sanding plate and ultimately of the sander body. Thus, this type of sander is unsuitable for a cordless or battery-operated sander.

OBJECTS OF THE INVENTION

It is, therefore, an object of the present invention to provide a novel cordless electric finishing sander which can eliminate the above noted disadvantages of the prior art, and which is easy to handle and reliable in operation.

It is another object of the present invention to provide such sander which is well balanced and compact in construction in order to improve the efficiency of operation.

It is a further object of the present invention to provide such sander which may facilitate reception and removal of the sandpaper and which may securely grip the sandpaper in its clamped position.

It is a still further object of the present invention to provide such sander having a switch mechanism which is simple in construction and easy to assemble.

The present invention will become more fully apparent from the claims and description as it proceeds in connection with the drawings.

DESCRIPTION OF THE PREFERRED EMBODIMENT

Figure 1:
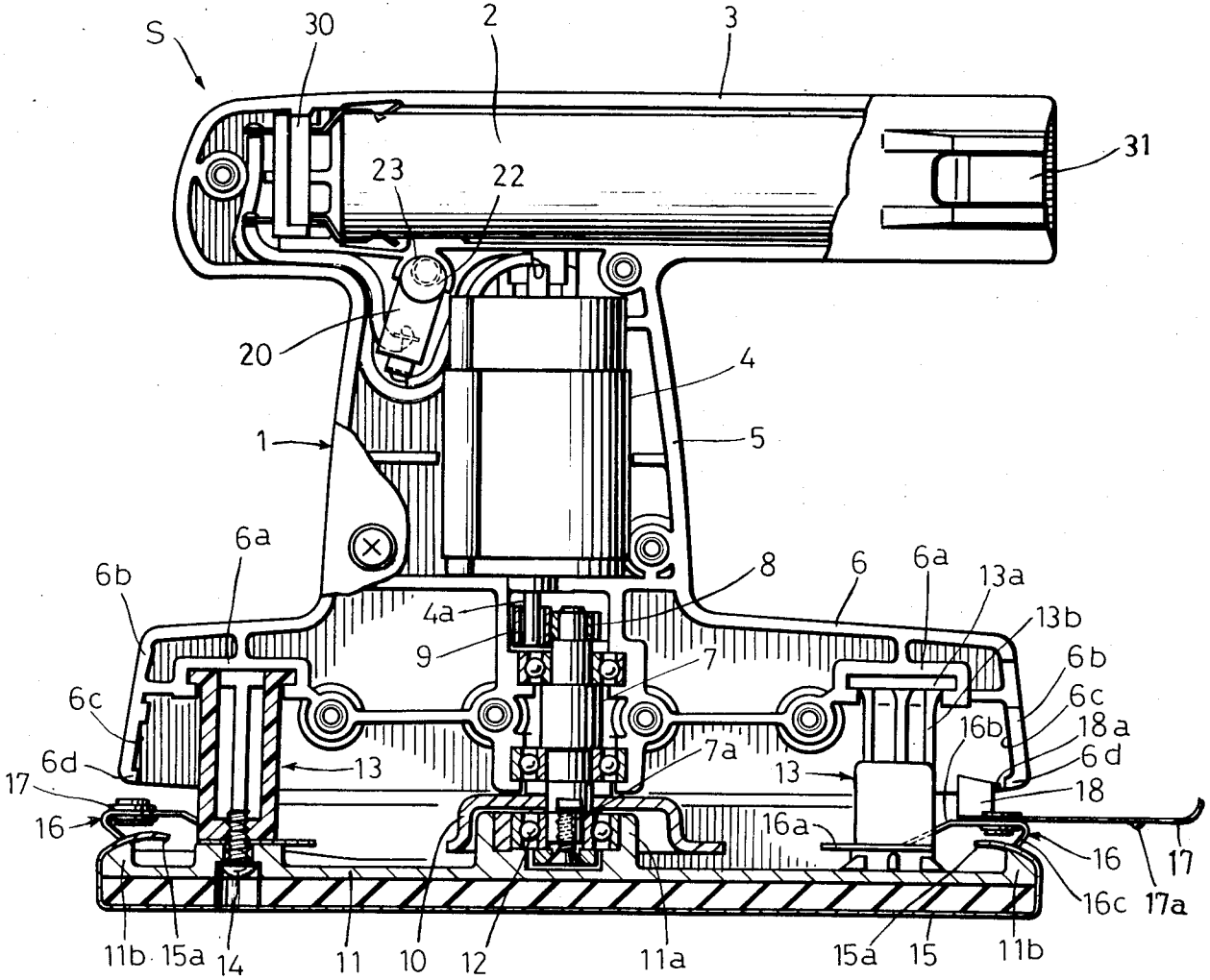
FIG. 1 is a vertical sectional view of a finishing sander embodying the invention.

Referring to the drawings in general, shown therein is a cordless electric finishing sander S constructed in accordance with the invention. As shown therein, the finishing sander S comprises a housing 1 of a generally recumbent H-shaped vertical cross-sectional configuration having a pair of complementary mating halves 1A and 1B which are detachably secured together along a common longitudinal midplane. The housing 1 has at the upper part thereof a horizontally elongated handle portion 3 for the user of the sander S to hold, the handle portion defining a compartment, including a forward end forward of the motor housing, for removably encasing a battery 2 therein. Below the handle portion 3 is a motor housing portion 5 for encasing a motor 4 with a motor shaft 4*a* driven by the battery 2. Further, the lower end of the housing 1 includes a skirt portion 6 having an open bottom end and encasing a transmission mechanism T driven by the motor 4. It is to be noted that the handle portion 3 and the skirt portion 6 are formed substantially symmetrically about the motor housing portion 5 in both vertical and longitudinal directions.

Referring now particularly to FIG. 1, it may be seen that the transmission mechanism T includes a drive shaft 7 rotatably mounted within the skirt portion 6 of the housing 1. Specifically, the upper end of the drive shaft 7 has mounted thereto a gear 8 which meshes a pinion 9 carried on the motor shaft 4*a* of the motor 4. The lower end of the drive shaft 7 has secured thereto a balancer 10 for rotation therewith. The lower end of the drive shaft 7 has an eccentric shaft portion 7*a* projecting downwardly of the skirt portion 6 and which is slightly eccentric relative to the central axis of the drive shaft 7.

Figure 2:
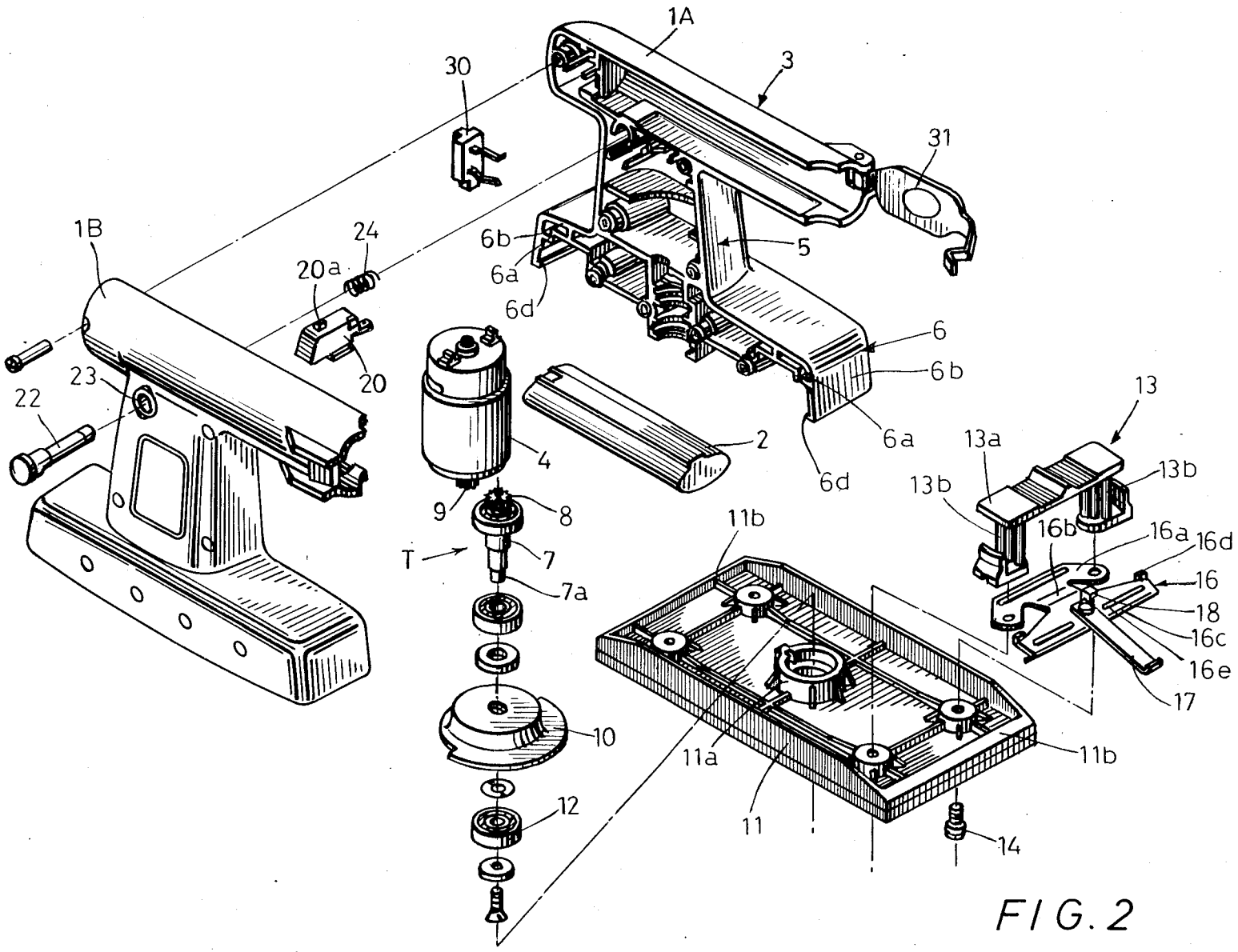
FIG. 2 is an exploded perspective view of the finishing sander of the invention.

A generally flat rectangular sanding plate 11 is mounted on the skirt portion 6 for orbital movement relative thereto. Specifically, the sanding plate 11 is formed at its central part with an annular projection 11*a* to receive a bearing 12, in which the eccentric shaft portion 7*a* of the drive shaft 7 is journalled. Thus, the eccentric rotation of the eccentric shaft portion 7*a* is transmitted to the sanding plate 11 so that the latter can effect an orbital motion in a horizontal plane. The sanding plate 11 is resiliently mounted to the skirt portion 6 by means of a pair of spaced apart parallel flexible members 13 positioned front and back thereon. As best shown in FIG. 2, each of the flexible members 13 has at the top thereof an integral bracket portion 13*a* which is adapted to be carried on a lateral supporting section 6*a* formed in the skirt portion 6. The flexible member 13 also has a pair of leg portions 13*b* extending downwardly from the opposite ends of the bracket portion 13*a*. The lower ends of the leg portions 13*b* are secured to the sanding plate 11 by means of machine screws 14. Thus, with the aid of flexible members 13, the sanding plate 11 is resiliently displaceable in a horizontal plane relative to the skirt portion 6.

Here again, it is to be noted that according to the invention, the weight of the overall sander S is distributed in both vertical and longitudinal directions such that the weight of the handle portion 3 encasing the battery 2 is substantially equal to the weight of the skirt portion 6 carrying the sanding plate 11.

Figure 3:
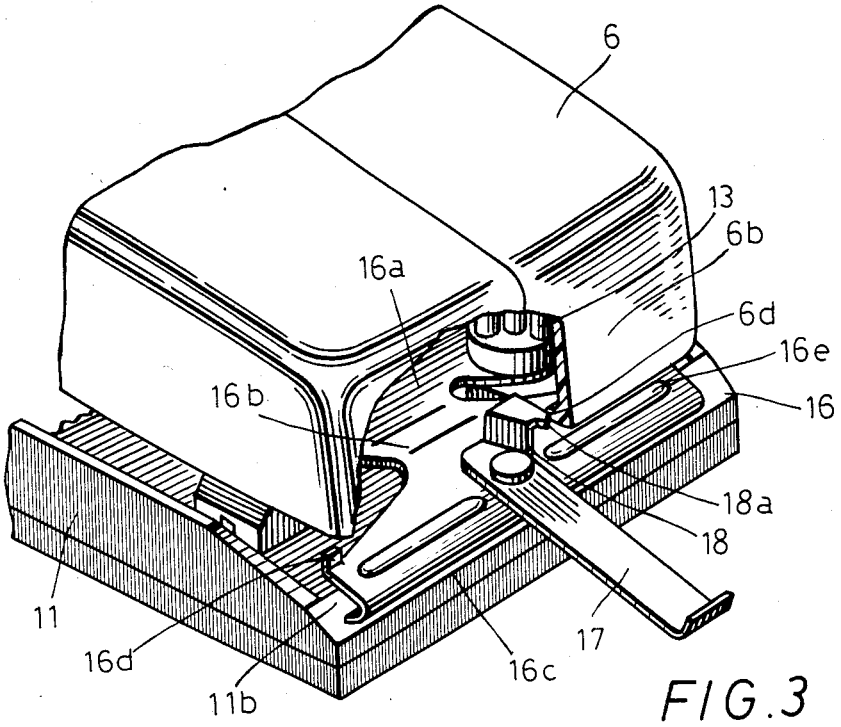
FIG. 3 is a perspective view of the clamping arrangement of the finishing sander.
Figure 4:
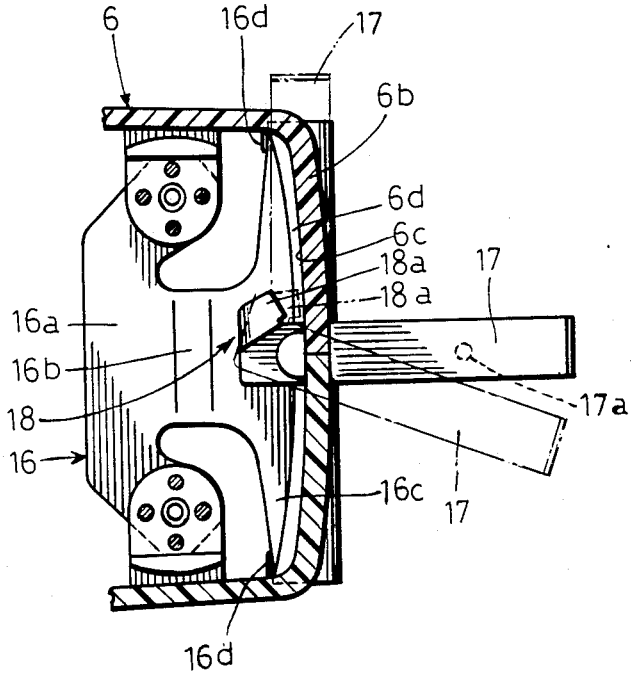
FIG. 4 is a plan view of the clamping arrangement.

A sheet of sandpaper 15 can be attached to the sanding plate 11 by a novel clamping means. As shown in FIG. 1, the clamping means comprises a pair of identical spaced apart clamping members 16 mounted on the opposite ends of the sanding plate 11 and adapted for resilient vertical movement relative thereto. The clamping members 16 serve to releasably grip the sandpaper 15 at its front and back edges 15*a* against oppositely disposed rib portions 11*b* of the sanding plate 11. As best shown in FIGS. 3 and 4, each of the clamping members 16 has a base portion 16*a*, the opposite ends of which is held between the sanding plate 11 and the flexible member 13. The clamping member 16 also has a narrow flexible portion 16*b* extending outwardly of the base portion 16*a* and a lateral elongated actuating portion 16*c* having an outer end bent downwardly for holding the edge 15*a* of the sandpaper 15 (not shown in FIG. 3 for clarity). The actuating portion 16*c* has vertical stoppers 16*d* formed on the inside opposite edges thereof. The actuating portion 16*c* also has a pair of lateral grooves 16*e* formed therein.

An operating lever 17 formed of sheet metal is provided to flex the clamping member 16 and hence to release the sandpaper 15. The operating lever 17 is horizontally pivotally connected to the medial portion of the actuating portion 16*c*. Thus, when the operating lever 17 is displaced to a position substantially normal to the inside surface 6*c* of the end wall 6*b* of the skirt portion 6, the operating lever 17 may be raised to lift the actuating portion 16*c* thereby flexing the clamping member 16 upwardly to release the sandpaper 15.

An important feature of the present invention resides in the pivotal arrangement for the operating lever 17 to be locked in its retracted position. To this end, the operating lever 17 is provided on its medial undersurface with a projection 17*a* serving to engage the groove 16*e* of the clamping member 16. Specifically, when the operating lever 17 is pivoted until it abuts on the stopper 16*d* and extends over the actuating portion 16*c*, as shown in phantom lines in FIG. 4, the operating lever 17 is retracted into a clearance defined between the end wall 6*b* of the skirt portion 6 and the rib portion 11*b* of the sanding plate 11. As this occurs, the projection 17*a* of the operating lever 17 engages the groove 16*e* of the actuating portion 16*c*, thereby locking the operating lever 17 in its retracted position.

Another important feature of the present invention resides in a novel arrangement which is effective to lock the clamping member 16 in its released position. To this end, the operating lever 17 has an inverted L-shaped locking piece 18 formed adjacent the pivotal end thereof. The locking piece 18 is provided at its upper part with a hooking edge 18*a* which is disposed in obliquely confronting relation to the inside wall surface 6*c* when the operating lever 17 is pivoted to a position normal to the inside wall surface 6*c*. Thus, when it is desired to exchange the sandpaper 15 for a different one, the operating lever 17 is displaced toward a position normal to the inside wall surface 6*c*, raised to unclamp the sandpaper 15, and subsequently pivoted slightly in a direction in which the locking piece 18 is displaced toward the inside wall surface 6*c*, as illustrated in phantom lines in FIG. 4. As this occurs, the hooking edge 18*a* engages a hooking ledge 6*d* formed on the lower part of the inside wall surface 6*c*. Thus, the operating lever 17 is locked in its raised position along with the actuating portion 16*c*, thereby locking the clamping member 16 in its released position. Conversely, when the operating lever 17 thus locked in its raised position is pushed in a direction in which the locking piece 18 moves away from the inside wall surface 6*c*, the clamping member 16 is resiliently returned to its operative position and is released from its locked position.

Referring now to FIGS. 5A, 5B, 6 and 7, shown therein is a switch mechanism SW for starting or stopping the motor 4 of the finishing sander S. As shown therein, the switch mechanism SW includes a switch 20 carried in recesses 21 formed in the mating halves 1A and 1B, respectively, of the housing 1. The switch 20 has a push button 20*a* adjacent the right upper end (as viewed in the drawing), which is adapted for downward movement and resilient return for closing and opening the contact of the switch 20.

A switch rod 22 is inserted into the handle portion 3 for horizontal movement relative thereto and is adapted to press and release the push button 20*a*. Specifically, the switch rod 22 is slidably inserted into a hole 23 extending through the mating halves 1A and 1B. The switch rod 22 is normally urged in the direction of withdrawal by a spring 24 disposed at the end of the hole 23. The switch rod 22 has a head end 22*a* of a stepped cylindrical configuration projecting outwardly from the handle portion 3. The switch rod 22 also has a substantially semi-cylindrical sliding portion 22*b* extending from the head end 22*a*. The sliding portion 22*b* has a flat lower surface 25 adapted to slidably contact the upper surface of the switch 20 so that the switch rod 22 is restricted against rotation. The sliding portion 22*b* also is provided at its distal end with an upwardly slanting, inner sliding surface 26 which is adapted to slide on the push button 20*a* of the switch 20 and press the puch button 20*a* when the switch rod 22 is inserted in the hole 23 and assembled with the handle portion 3.

Figure 5A:
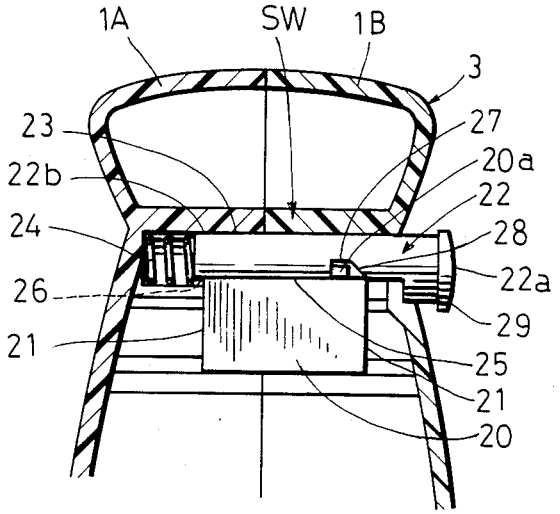
FIGS. 5A and 5B are front views of the switch mechanism under off and on conditions, respectively.
Figure 5B:
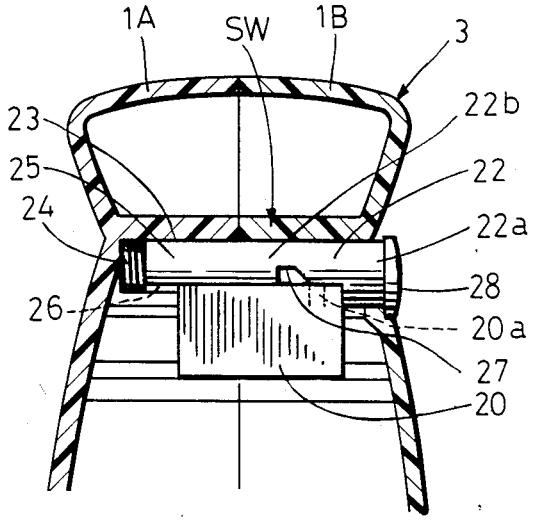
Figure 6:
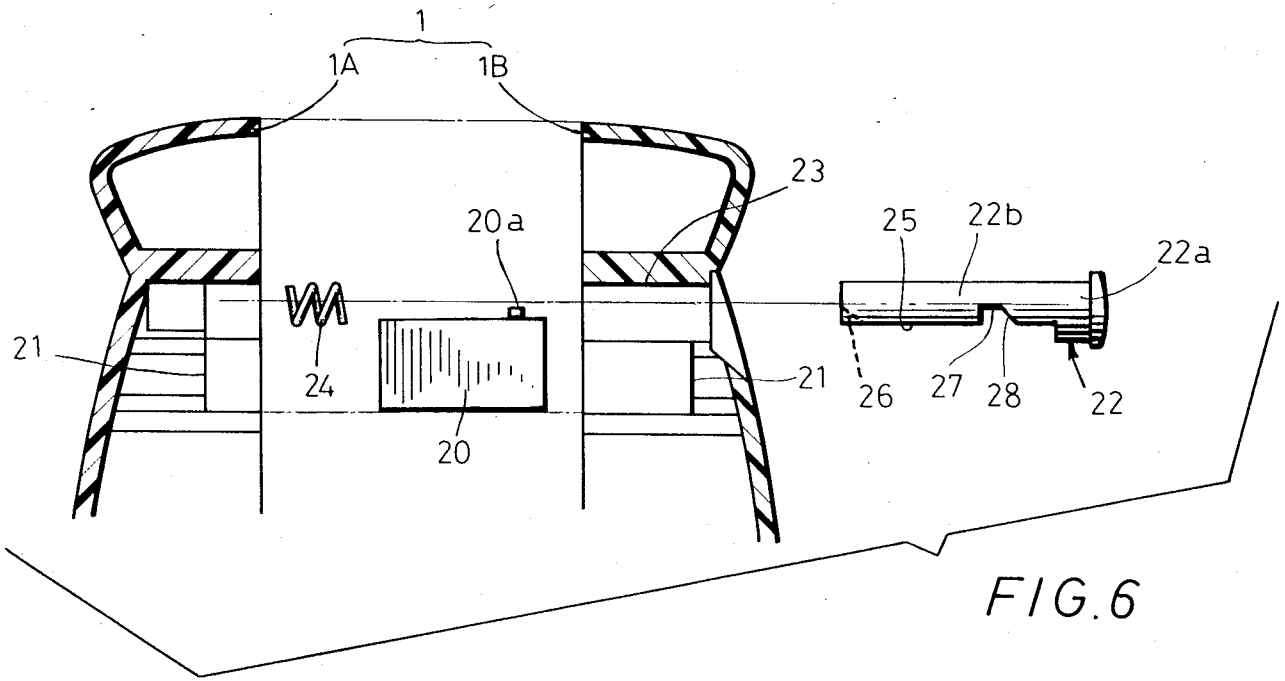
FIG. 6 is an exploded front view of the switch mechanism.
Figure 7:
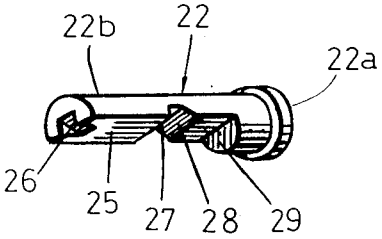
FIG. 7 is a perspective view of the switch rod.

The lower surface 25 of the switch rod 22 is formed with an operating channel section 27 which is so configured as to allow the upward movement of the push button 20*a* pressed downward by the lower surface 25 and hold the same in its extended position (FIG. 5A). The operating section 27 also is effective to hold the switch rod 22 in place when assembled, restricting the same against coming-out. The lower surface 25 also is formed on the outside surface of the operating section 27 with an outer sliding surface 28 which is disposed substantially in parallel relation to the inner sliding surface 26. The outer sliding surface 28 serves to slidingly contact the push button 20*a* and guide the downward movement of the same. Specifically, when the switch rod 22 as assembled to the handle portion 3 is pushed inward in opposition to the force of the spring 24 until the inside end surface, indicated at 29, abuts on the right end surface of the switch 20, the outer sliding surface 28 slides on the push button 20*a* to thereby push the same downward below the lower surface 25 adjacent the head end 22*a* (FIG. 5B). Thus, when the switch rod 22 is pushed inward, the push button 20*a* is depressed by the outer sliding surface 28 thereby closing the contact of the switch 20 and starting the motor 4. Conversely, when the switch rod 22 is released from its pushed position, the switch rod 22 is resiliently retracted to be returned to its original position. As this occurs, the push button projects into the operating section 27 (FIG. 5A), thereby opening the contact of the switch 20 and stopping the motor 4.

Reference numeral 30 designates a battery holder mounted within the forward portion of the handle portion compartment generally forward of the motor housing 5 and reference numeral 31 is a cover plate pinned to the rear end of the handle portion 3 for opening and closing the handle portion 3.

The advantages of the constructions and teaching of the present invention may be reviewed and summarized briefly as follows.

According to the present invention, the housing 1 of the finishing sander S has the handle portion 3 formed on the upper part thereof and defining a compartment adapted for storing the battery 2, the motor housing portion 5 extending below the handle portion 3 for storing the motor 4 energized by the battery 2, and the skirt portion 6 to which the sanding plate 11 is mounted for orbital movement relative thereto.

Thus, the specific arrangement of the invention eliminates the need for providing a power cord which tends to limit the range of movement of the sander S. The sander S can be easily operated and made compact. Also, since the weight of the sander S is balanced in vertical and longitudinal directions, the sander S may be smoothly moved and operated, increasing the efficiency of operation.

The clamping mechanism is encased within the skirt portion 6 and the operating lever 17 may be stored between the sanding plate 11 and the skirt portion 6 whereby the sander S may be made compact, there being no member projecting outwardly of the skirt portion 6 which tends to engage a solid object.

The operating lever 17 for the clamping member 16 includes the locking piece 18 for retaining the clamping member 16 in its released position, so that the sandpaper 15 may be replaced with the greatest facility.

Further, the switch rod 22 of the switch mechanism SW is inserted into the hole 23 and assembled to the handle portion 3 such that the switch rod 22 engages the push button 20*a* of the switch 20. Thus, the switch mechanism SM may be simple in construction.

Figure 8:
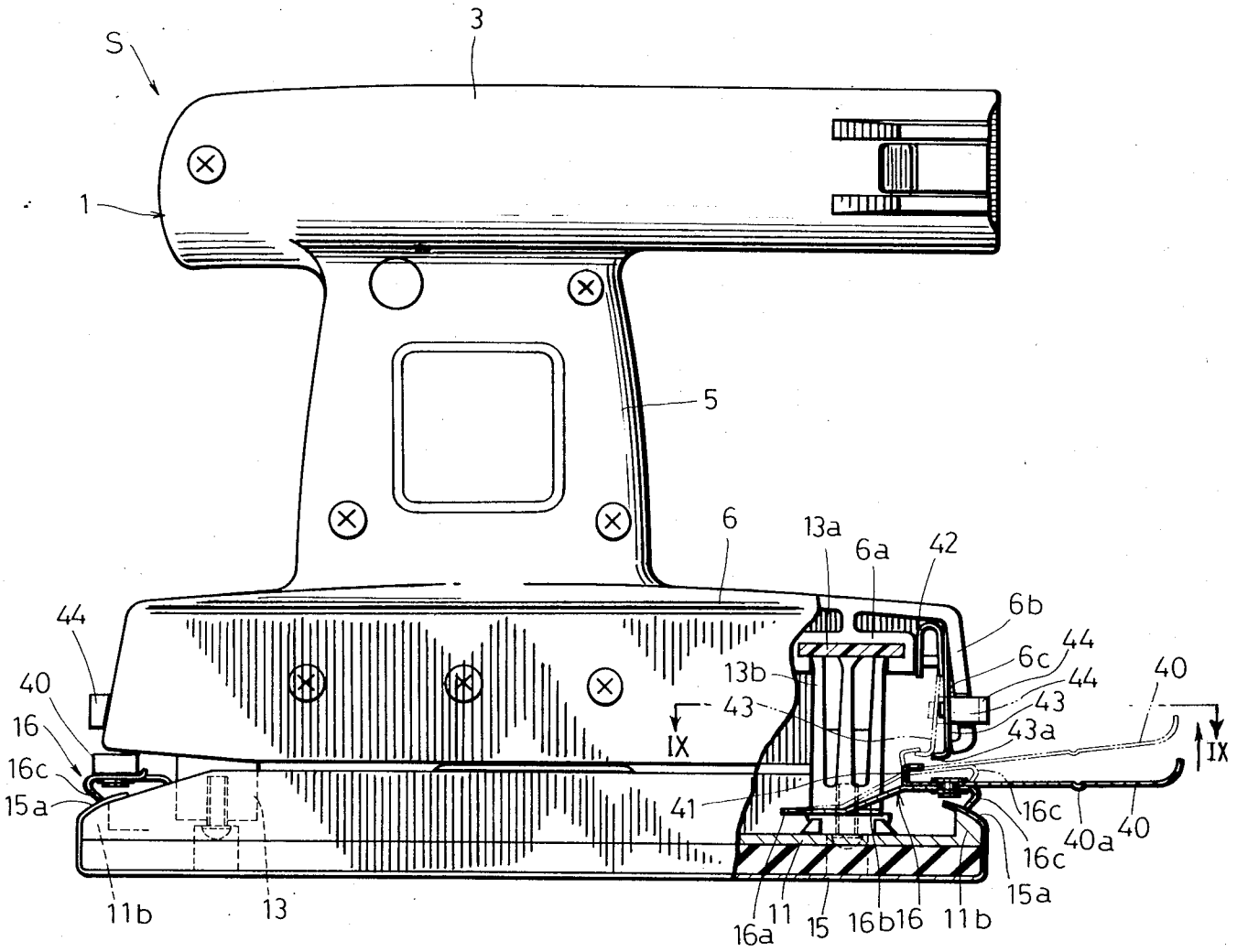
FIG. 8 is a partially sectioned side elevational view of the finishing sander showing an alternative arrangement of clamping mechanism.
Figure 9:
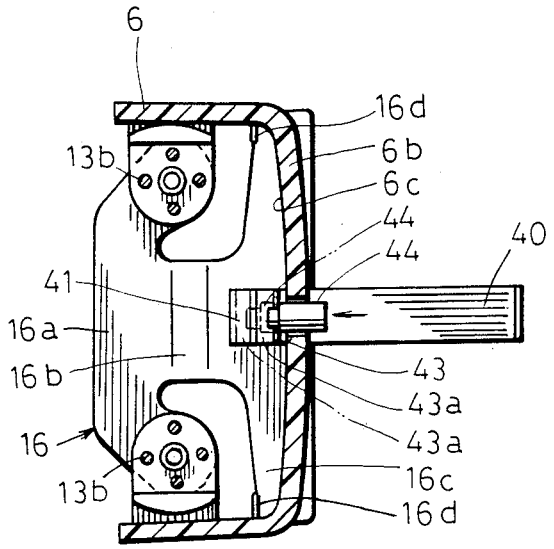
FIG. 9 is a sectional view taken along the line IX—IX of FIG. 8.
Figure 10:
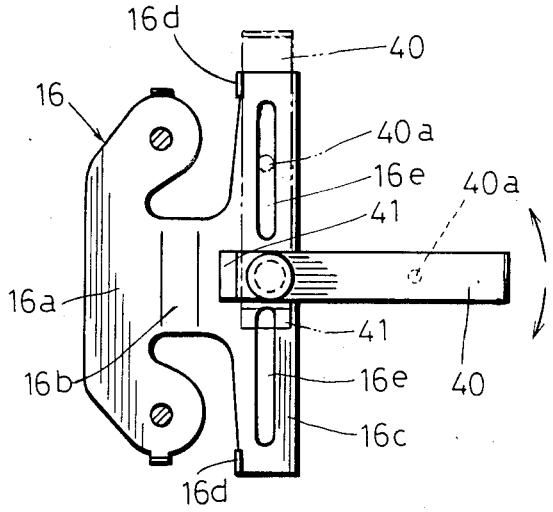
FIG. 10 is a plan view of the alternative clamping arrangement.

FIGS. 8 to 10 illustrate an alternative arrangement of clamping means that may be utilized in the sander S. Basically, the difference is that a modified operating lever 40 and an alternative arrangement are provided for locking the clamping member 16 in its released position. As may be seen, an operating lever 40 is provided corresponding to the operating lever 17 described above and having on its medial undersurface a projection 40*a* serving to engage the groove 16*e* formed in the actuating portion 16*c* of the clamping member 16, so that the operating lever 40 may be locked in its retracted position. The operating lever 40 also is provided with an inverted L-shaped locking piece 41, the upper part of which is disposed in parallel relation to the inside wall surface 6*c* of the skirt portion 6 when the operating lever 40 is pivoted to a position perpendicular to the inside wall surface 6*c*.

An inverted U-shaped resilient member 42 is positioned within the skirt portion 6 adjacent the supporting section 6*a*. An upstanding member 43 is positioned between the resilient member 42 and the end wall 6*b* and extending downwardly along the wall surface 6*c*. The lower end of the upstanding member 43 is bent to provide a hooking piece 43*a* positioned in confronting relation with the locking piece 41 when the operating lever 40 is pivoted to a position perpendicular to the inside wall surface 6*c*.

A push button 44 is operatively connected to the medial portion of the upstanding member 43 and extending through the end wall 6*b* of the skirt portion 6, the outer distal end projecting outwardly of the skirt portion 6. Thus, when the push button 44 is pushed inwardly, as illustrated in phantom lines in FIGS. 8 and 9, with the operating lever 40 pivoted to a position perpendicular to the inside surface 6*c*, the upstanding member 43 is inclined inwardly and the hooking piece 43*a* latches the locking piece 41 of the operating lever 40. The operating lever 40 is then locked in its raised position along with the actuating portion 16*c* of the clamping member 16, and the clamping member 16 may be locked in its released position. When the locked operating lever 40 is further pushed upwardly, the locking piece 41 is disengaged from the hooking piece 43*a*, thereby returning the actuating portion 16*c* to its original posture and releasing the clamping member 16 from its locked position. As this occurs, the upstanding member 43 is returned to its original posture under the spring force exerted by the resilient member 42.

While the invention has been described with reference to preferred embodiments thereof, it is to be understood that modifications or variations may be easily made without departing from the spirit of this invention which is defined by the appended claims.

What is claimed is:

1. A portable cordless finishing sander comprising:

(a) a housing having a pair of mating housing portions detachably secured together along a common plane, said housing providing (1) a motor housing portion formed on the medial part thereof for storing an electric motor therein, (2) an elongated handle portion horizontally extending above said motor housing portion and having formed therein a compartment for storing a battery to drive said electric motor, the forward end of said compartment being disposed generally forwardly of said motor housing and achieving balance of weight between the front and rear of said sander, (3) a skirt portion extending below said motor housing portion;

(b) a sandling plate extending below and resiliently carried by said skirt portion of said housing for orbital motion relative thereto; and (c) a pair of clamping means mounted to said sanding plate for clamping a sheet of sandpaper to said sanding plate.

2. The finishing sander as defined in claim 1 wherein said pair of clamping means each comprises a clamping member secured to said sanding plate, and an operating lever operatively connected to said clamping member, said operating lever being vertically movable to flex said clamping member and thereby to release the same from its operative clamping position, and said operating lever being horizontally movable from an operative position extending outwardly of the skirt portion to an inactive position to be stored between said skirt portion and said sanding plate.

3. The finishing sander as defined in claim 2 wherein said skirt portion of said housing includes means for latching said operating lever and thence retaining said clamping member in its released position when said clamping member is flexed in a direction in which said sandpaper is unclamped.

4. The finishing sander as defined in claim 1 further comprising a switch with a push button serving to start or stop said electric motor and located in said handle portion generally forwardly of the front-to-rear center of gravity of said sander and a switch rod operatively mounted on said handle portion and disposed in parallel relation to said switch, said switch rod having formed thereon an operating channel section into which said push button is projectable to thereby hold said switch rod against coming-out, said operating channel section having a sliding slant surface effective to depress said push button when said switch rod is pushed.

* * * * *